United States Patent [19]

Langwadt

[11] 4,449,855

[45] May 22, 1984

[54] ANCHOR HEAD FOR A CORROSION-PROTECTED INJECTED ANCHOR

[75] Inventor: Otmar Langwadt, Munich, Fed. Rep. of Germany

[73] Assignee: Dyckerhoff & Widmann Aktiengesellschaft, Munich, Fed. Rep. of Germany

[21] Appl. No.: 389,562

[22] Filed: Jun. 17, 1982

[30] Foreign Application Priority Data

Jun. 26, 1981 [DE] Fed. Rep. of Germany ..... 3125166

[51] Int. Cl.[3] ..... E21D 20/02

[52] U.S. Cl. ..... 405/260; 52/223 R

[58] Field of Search ..... 52/230, 223 L, 223 R, 52/698; 405/259, 260, 262

[56] References Cited

U.S. PATENT DOCUMENTS 3,437,359 4/1969 Hunter ..... 52/230
3,738,071 6/1973 Finsterwalder ..... 405/260

FOREIGN PATENT DOCUMENTS 222320 7/1962 Austria ..... 52/230
1262423 4/1961 France ..... 52/230
57-169129 10/1982 Japan ..... 405/260
197712 12/1977 U.S.S.R. ..... 52/223

*Primary Examiner*—John E. Murtagh
*Assistant Examiner*—Kathryn Ford
*Attorney, Agent, or Firm*—Toren, McGeady and Stanger

[57] ABSTRACT

An anchor head for a corrosion-protected prestressable injected anchor secures the end of a bundle of steel members, such as rods, wires or strands. The anchor head includes an abutment member and an anchor plate supported on the abutment member. The anchor plate has bores for receiving and anchoring the ends of the individual steel members. The bundle of steel members extends through a borehole and between the borehole and the abutment member the steel members are fanned or spread out before entering the anchor plate. Each of the steel members is covered with a corrosion protective sheathing. A closure plate is arranged at the abutment member and has a number of openings corresponding to the number of steel members. The steel members pass through the closure plate in a sealed manner.

3 Claims, 3 Drawing Figures

FIG. 1
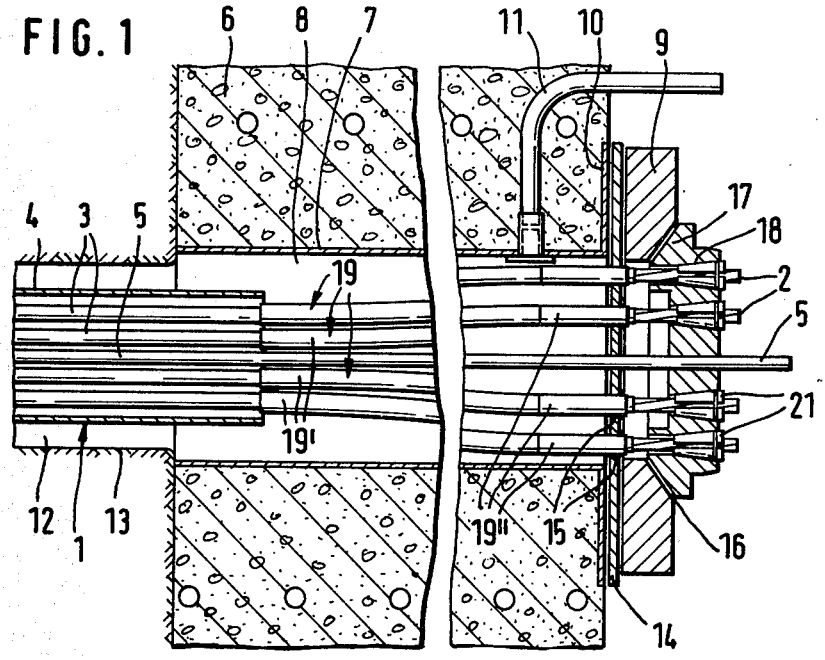
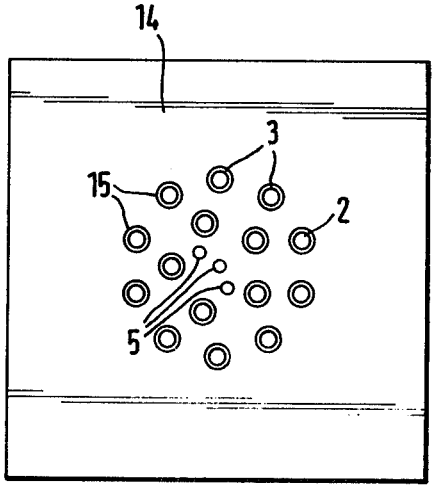
FIG. 2

ANCHOR HEAD FOR A CORROSION-PROTECTED INJECTED ANCHOR

SUMMARY OF THE INVENTION

The present invention is directed to an anchor head for a corrosion-protected, prestressable injected anchor with an abutment member and an anchor plate supported against the abutment member for securing the ends of the anchor. The anchor plate is provided with bores for receiving the individual elements of the tension member made up of a bundle of steel members such as rods, wires or strands. The individual elements fan out or spread apart as they approach the anchor head and each element is provided with a corrosion protection sheathing.

In a known injected anchor of this type, the tension member consists of several steel rods which, in the area of the free length of the span of the member, are individually enclosed in a tubular sheath and fan out toward the anchor head, note German Pat. No. 20 41 526. This injected anchor is used only for temporary purposes, such as for anchoring an excavation wall and it does not require the rorrosion protection used in a so-called permanent anchor. In setting up this anchor, after the tension member is inserted into the borehole, cement mortar or grout is injected for the length of the anchor. The injected material, however, may also extend over the free length of the span if for instance, due to the tubular sheaths, the free longitudinal mobility of the steel rods making up the tension member is assured in the free span region for tensioning or post-tensioning. For this anchor, corrosion protection of the steel rods is sufficient along the length of the anchor afforded by the injected member and for the free length of the span as afforded by the tubular sheaths.

The requirements concerning the quality of corrosion protection for permanent anchors are greater, since the tension members providing the anchoring spend a much longer period in the ground. In such an anchor, it is known to guide the tension member over its entire length in a corrosion-protection sheathing and, moreover, to inject the hollow space about the tension member with a cement mortar or grout, note German Pat. No. 17 59 561. The tension member may consist of several individual elements. Accordingly, possible defective areas in the injected member are prevented. If the length of the anchor is injected first, defective areas may develop at the end facing the outside where water may accumulate.

In injected anchors of this type, the outer hollow space between the tubular sheath and the wall of the borehole must be sealed toward the anchor head to assure that injection is correctly effected. This can be done by means of seals, in the form of sealing rings, which are arranged between the tubular sheath and the borehead wall or an outer tube which limits the anchor head area, before the individual elements are fanned out toward the anchor head. With the seals in place, the individual elements are then fanned out or spread in the region of the anchor head and then they are deflected inwardly by annular spacers so that they are guided in the spread relation through bores in the anchor plate in approximately parallel relation with one another. To be able to absorb the high, inwardly directed deflecting forces, the spacers are made of metal. In this permanent anchor the entire space containing the fanned out portions must be filled out subsequently with a corrosion protection material. Such an operation is very time-consuming and expensive. During tensioning, the individual elements are guided along the deflection region at the spacers where, due to the friction of metal on metal, there is the danger that friction martensite occurs and promotes the susceptibility to corrosion of the individual elements in that region.

Therefore, the primary object of the present invention is to provide an anchor head for a ground anchor or rock anchor for use as a permanent anchor so that the disadvantages of known anchors are avoided and so that the hollow space between the tubular sheaths on the individual steel members of the tension member can be injected with grout or cement mortar up to the anchor head whereby corrosion of the individual elements due to deflection during tensioning is prevented.

In accordance with the present invention, an anchor head of the above-described type is arranged so that, in the region of the abutment member on the side facing the borehole, a closure plate is provided with a number of bores or openings corresponding to the number of individual elements making up the tension member with each of the elements guided in a sealing manner through an opening in the closure plate. Preferably, each individual elements of the tension member is enclosed within a sleeve tube, formed of plastic, in the region approaching and passing through the closure plate.

Such sleeve tubes extend over the region in which the individual elements are fanned out relative to one another. The sleeve tubes preferably consist of two parts, one a curved part in the region where the elements are fanned outwardly and such part is installed before the closure plate is set in place, and the other a straight part which extends on the elements in the region of the closure plate and is installed after the closure plate is set in place.

Due to the location of the closure plate at the anchor head and to the sealed guidance of the individual elements of the tension member through the closure plate, the hollow space in the borehole can be injected and is closed off at the anchor head so that the region in which the individual elements are fanned out toward the anchor head can also be injected. With the individual elements in the fanned out region embedded in the hardened injected material so as to be longitudinally movable, there is the additional advantage that the deflecting forces in the form of transverse forces and pressure which develop during tensioning along the bending line are absorbed by the hardened injected material so that sharp deflection edges are prevented such as occur in punctiform spacers. Only the region of the anchor head outwardly from the closure plate needs to be injected with corrosion protection material so that there is a saving in both time and money.

The various features of novelty which characterize the invention are pointed out with particularity in the claims annexed to and forming a part of this disclosure. For a better understanding of the invention, it operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1 is a longitudinal sectional view throuh an anchor head embodying the present invention;

FIG. 2 is a sectional view taken along the line II—II in FIG. 1; and

DETAIL DESCRIPTION OF THE INVENTION

Figure 3:
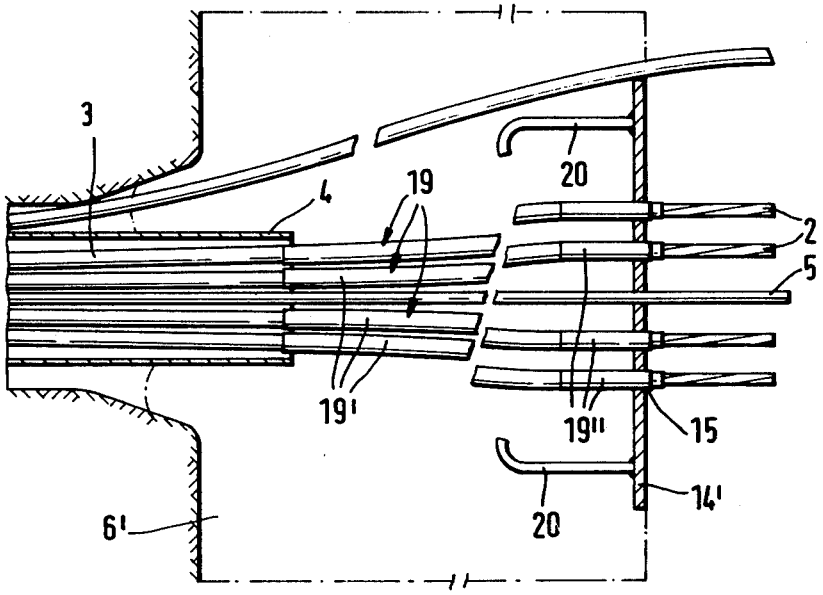
FIG. 3 is a longitudinal sectional view similar to FIG. 1, however, showing another embodiment of the present invention.

In FIG. 1 only the anchor head at the end of a permanent anchor with increased corrosion protection is shown. The anchor includes a tension member 1 made up of a bundle of strands 2 each enclosed in the free length of the steel strands by a protective plastic sheath 3, for instance polyethylene, as corrosion protection. The bundle of strands 2 is located within a protective tube 4. One or two injection tubes or venting tubes 5 are guided through the center of the bundle.

As shown in FIG. 1, the anchoring force acts against a concrete layer or body 6 which equalizes the solid rock or ground. Extending through the concrete layer 6 in the long direction of the tension member 1, is a form tube 7. The form tube 7 encloses a hollow space 8 forming a continuation of the borehole through which the tension member 1 extends. Within the region of the hollow space 8 in the tube 7, strands 2 are fanned out or spread apart in the direction toward the anchor head 9. A bed plate 10 is connected to the outer end of the form tube 7 extending transversely of the axis of the tube and creating a planar support area. If it is assumed that a falling anchor is illustrated in the drawing, that is, where the anchor head is located at a position higher than the lower end of the tension member, then the tubes 5 serves as injection tubes through which the entire outer hollow space within the borehole wall 13 and about the tension member 1 can be filled with grout or cement mortar. Air, enclosed in the borehole, can escape through a vent line 11.

A closure plate 14 adjoins the bed plate 10 and has a plurality of openings or bores 15 through which the strands 2 and their sheathing 3 can be guided. An abutment member 9 is located against the outside face of the closure plate 14. On the outwardly facing side of the abutment member 9 a frustoconical seat area is provided for an anchor plate 17 which has a complementary frusto-conical shape about a part of its circumferential periphery. Anchor plate 17 has a number of conically shaped bores 18 in which the strands can be fixed by multipart tapered collars 21.

In the region within the form tube 7 from the end of the protective tube 4 to the closure plate 14, each strand is individually enclosed within sheating 3 and also within a sleeve tube 19 which extends along the length of the fanned-out portion of the strand 2 up to the closure plate 14. Each sleeve tube 19 consists of two parts extending in the long direction of the strands 2, a first part 19' which encloses the doubly curved section of the strand where the strand fans outwardly, and a second straight part 19" which affords a seal for the strands in the region of the closure plate 14. The material and dimensions of the second parts 19" of the sleeve tube 19 are selected so that the annular space about each strand or about the protective sheating 3 on each strand within the bores 15 in the closure plate 14 are completely filled and sealed so that each element is tightly fitted to the plate, note FIG. 2.

During the installation of the anchor head, initially the parts 19' of the sleeve tubes 19 are pushed on the strands 2 in their double curved region which are located inside the form tube 7 and extend into the end of the protective tube 4. Next, the strands 2 are placed through the bores 15 in the closure plate 14. The shorter straight parts 19" of the sleeve tubes are then pushed onto the strands 2 through the bores 15 in the closure plate until they protrude beyond the side of the closure plate facing toward the form tube 7. As can be seen in FIG. 1, the straight parts 19" project into the adjacent end of the form tube 7. Finally, the abutment member 9 along with the anchor plate 17 are placed in a manner known per se and the elements are inserted through the conically shaped bores 18 in the anchor plate. In this assembled arrangement, the entire hollow or open space 19 within the form tube 7 is injected up to the closure plate 14 with grout or cement mortar through the injection line 5 which also passes through the closure plate. Venting takes place through the vent tube 11. After the injected material has hardened, the tension member 1 is tensioned in a manner known per se. During the tensioning operation, the strands slide within their sheaths 3 inside the sleeve tubes 19 along the continuously curved sections of the fanned out portion of the elements which were formed before injection, and the strands are guided in an axis-parallel relation through the bores 15 in the closure plate 14.

In FIG. 3 another longitudinal section is shown, similar to that in FIG. 1, illustrating an embodiment in which the concrete layer 6' is placed after the installation of the tension member. In this embodiment, the form tube 7 is also omitted. Closure plate 14' is held in the concrete layer by anchoring members 20 secured to the surface of the plate facing toward the borehole through which the tension member extends. The closure plate 14' serves as a part of the form work for the concrete layer 6' and secures the spacing of the strands 2 when the concrete layer is poured. Otherwise, this embodiment corresponds to the one shown in FIG. 1.

The arrangement of the anchor head with the closure plate 14 shown here only as an example of a falling anchor, can in an appropriate form also be used for rising anchors. Only the function of the injection tubes and the venting tubes needs to be reversed to secure venting in the depth of the borehole.

While specific embodiments of the invention have been shown and described in detail to illustrate the application of the inventive principles, it will be understood that the invention may be embodied otherwise without departing from such principles.

I claim:

1. An anchor head for a corrosion-protected prestressable injected anchor for use as a permanent ground anchor or rock anchor comprising a tension member arranged to extend through and out of a borehole, said tension member comprising a plurality of individual steel members arranged in a bundle, an abutment member arranged to be located spaced outwardly from the borehole, an anchor plate supported on said abutment member on the opposite side thereof from the borehole, said anchor plate having bores therethrough each for an individual one of said steel members, said anchor plate having a first surface facing in the direction of said bundle of steel members and an oppositely directed second surface, said bundle of steel members being in closely spaced relation within the borehole and fanned outwardly relative to one another between the borehole and said abutment member, a corrosion sheathing on each of said steel members, a closure plate located on the first surface side of said anchor plate and spaced from said anchor plate by said abutment member, said closure plate having a number of openings therethrough corresponding to the number of said steel members, said steel members extend through said openings in said closure plate, a sleeve tube laterally encloses each of said steel members and said corrosion sheathing on said steel members in the fanned-out region thereof and in the region where the steel members extend through said closure plate so that said steel members extend through said closure plate in a sealed manner, and means cooperating with said another plate for fixing the ends of said steel members in said anchor plate.

2. An anchor head, as set forth in claim 1, wherein said sleeve tubes extend for the length of said elements in the fanned-out regions thereof.

3. An anchor head, according to claim 2, wherein in the fanned-out regions of said steel members each steel member has a curved portion spaced from said closure plate, each of said sleeve tubes is comprised of a first part and a second part with said first part laterally enclosing the curved portion of said steel members in the fanned-out region, and a straight second part extending from the first part through said closure plate and said first parts being installed before said closure plate is set in place and said second parts being installed after said closure plate is set in place.

* * * * *